United States Patent [19]

Arthur

[11] Patent Number: 4,582,732

[45] Date of Patent: Apr. 15, 1986

[54] FILTER ROD MAKING MACHINES

[75] Inventor: Hugh M. Arthur, High Wycombe, England

[73] Assignee: Molins Limited, Great Britain

[21] Appl. No.: 274,177

[22] Filed: Jun. 16, 1981

[30] Foreign Application Priority Data

Jun. 17, 1980 [GB] United Kingdom ..... 8019730

[51] Int. Cl.[4] ..... B05D 1/02

[52] U.S. Cl. ..... 427/424; 118/316; 118/325; 118/326

[58] Field of Search ..... 118/692, 325, 326, 316, 118/314; 427/424

[56] References Cited

U.S. PATENT DOCUMENTS

| | | | |
|---|---|---|---|
| 3,156,582 | 11/1964 | Parker | 118/692 |
| 4,132,189 | 1/1979 | Greve et al. | 118/DIG. 16 |
| 4,313,974 | 2/1982 | Greve et al. | 118/325 X |
| 4,317,425 | 3/1982 | Greve et al. | 118/325 X |
| 4,367,249 | 1/1983 | Bloom et al. | 427/345 |

FOREIGN PATENT DOCUMENTS

| | | |
|---|---|---|
| 1290346 | 9/1972 | United Kingdom . |
| 1328151 | 8/1973 | United Kingdom . |

*Primary Examiner*—Shrive P. Beck

*Attorney, Agent, or Firm*—Antonelli, Terry & Wands

[57] ABSTRACT

Plasticizer or other fluid additive is applied to a moving filter tow in an applicator chamber by means of a rotary brush. Uncaptured plasticizer is collected in a container and returned to the chamber for reapplication. The rate of initial application is controlled by a pump and that of reapplication by a restrictor valve; the rates are independently variable. The supplied and collected plasticizer may be applied to different parts of the tow, e.g. to different sides.

41 Claims, 1 Drawing Figure

FILTER ROD MAKING MACHINES

Figure 1:
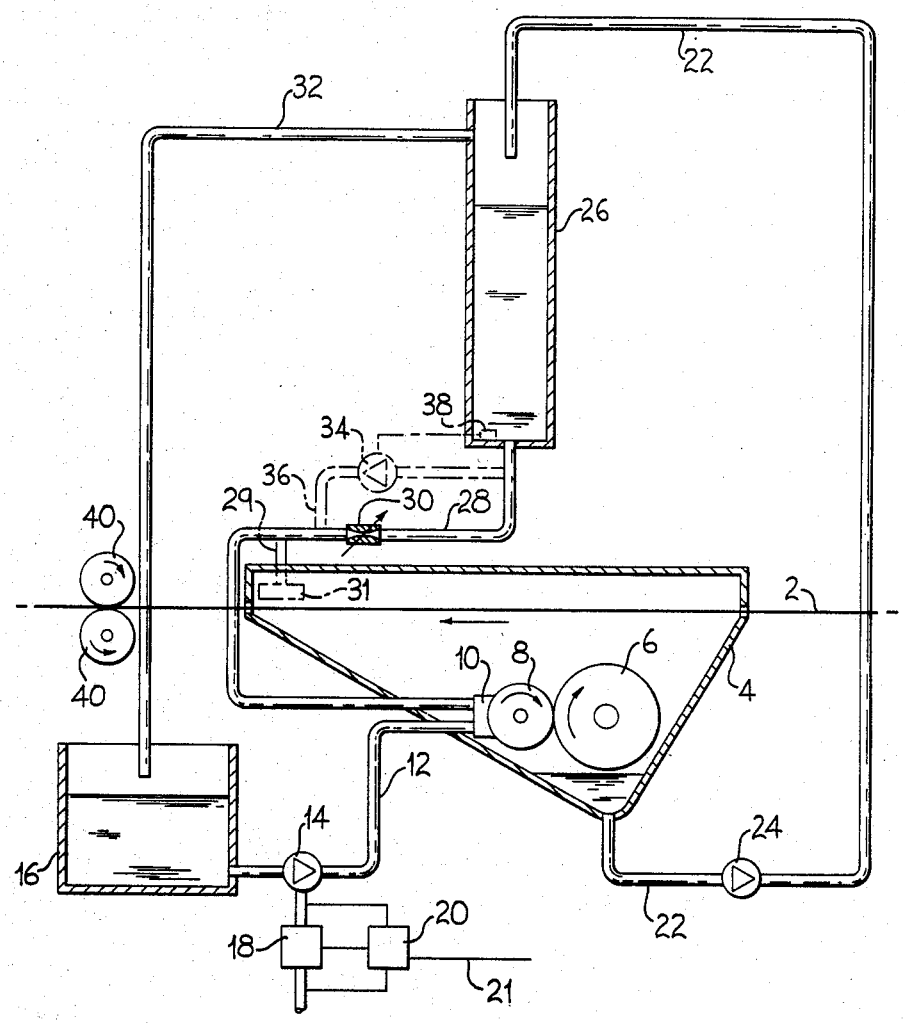

Filter rods, for making filter plugs for attachment to cigarette lengths, may be made by continuously forming a tow of filter material, e.g. cellulose acetate, into a rod in a filter rod making machine, e.g. Molins PM5N. Conventionally a so-called plasticiser (commonly glyceryl triacetate) is added to the tow before it is passed into the rod-forming device. When cured, the plasticiser improves the properties of the finished rod, e.g. by hardening it or providing a beneficial additional filtering effect.

It is desirable that the correct amount of plasticiser is added to the tow, i.e. an amount just sufficient to secure the required improvement in properties of the rod. The present invention is particularly concerned with controlling the supply of plasticiser or similar fluid additive to the tow.

Plasticiser is commonly added to the tow in an applicator booth or chamber in which the tow passes through a spray of plasticiser droplets. Plasticiser is normally continuously supplied to the booth at a rate which exceeds that at which it is retained by the tow and so removed from the booth. For example, only 60% of the plasticiser directed at the tow may be captured by the tow. The remaining 40% may be returned to a supply of plasticiser, together with other plasticiser (if any) supplied to the booth but not captured by the tow.

According to one aspect of the present invention apparatus for applying fluid additive to a moving filter tow includes means for supplying fluid additive to an applicator chamber for application to the tow, e.g. by spraying, means for collecting fluid additive not captured by the tow, and means for reapplying said collected fluid additive to the tow at a rate controllable independently of the rate of supply of fluid additive to the applicator chamber.

Preferably the means for supplying fluid additive is arranged to supply it to the chamber at a desired rate of application to the tow. The means for reapplying collected fluid additive may then be arranged so that the proportion of the reapplied collected fluid additive which is captured compensates for the uncaptured proportion of the additive supplied by the supply means. Since, for example, only 60% of the fluid additive may be captured, in that case 40% will pass to the collecting means. Since, however, the collecting means will also collect some reapplied collected additive which is again not captured the rate of collection of fluid additive may easily exceed that of the main supply. In order to achieve the required capture rate it may be necessary to supply collected additive at a relatively high rate; clearly this cannot exceed the rate of collection indefinitely but since the rate of collection will to a significant extent depend on the rate of reapplication of collected fluid additive the rate of reapplication can be varied to achieve a required total application rate. When the rate of supply from the supply means (i.e. from a source) is set at the desired capture rate of additive by the tow the latter rate is achieved when the quantity of collected fluid additive (including that circulating and not captured by the tow) is constant, since then the tow must be removing fluid additive from the chamber at the rate of supply to the chamber. In some cases, particularly where the proportion of supplied fluid additive which is initially captured is relatively low, it may be desirable to supply additive at a rate greater than that required to be collected by the tow; some of the uncaptured (i.e. collected) additive may then need to be returned to the supply if the flow path for reapplying collected additive has insufficient capacity.

The collected fluid additive is preferably reapplied to the tow by way of a flow path to applicator means within the chamber. The path may be external to the chamber and may include control means for varying the rate of flow. The path may include a reservoir. Collected fluid additive stored in the reservoir may be returned for reapplication at a rate which varies with the quantity stored in the reservoir.

The applicator means for collected fluid additive may be the same as applicator means for the main supply, e.g. from an external source. However, the applicator means for collected fluid additive may be separate from any such main supply applicator means, and may be separately located within the chamber. For example, different parts of the tow may be supplied by the separate applicator means so as to improve the distrubution of fluid additive in the tow. The respective applicator means may apply fluid additive to different sides of the tow, i.e. the applicator means may be laterally spaced or with one above and one below the tow.

According to another aspect of the invention a method of applying fluid additive to a continuously moving tow comprises supplying fluid additive to the tow, collecting fluid additive not captured by the tow, and controlling the rate of reapplication of the collected additive to achieve a required final application rate. Preferably the collected additive is reapplied at a rate which is variable independently of the rate of main supply of additive. Preferably the fluid additive is supplied at the rate at which it is required to impregnate the tow with the additive, the collected additive being recirculated until it is captured. The collected additive may be applied at a different location, selected for example to improve the distribution of additive through the tow.

According to a further aspect of the invention a method of applying fluid additive to a continuously moving tow comprises supplying fluid additive to the tow, collecting additive not captured by the tow, and reapplying said collected additive at a position spaced from the collection position. Thus collected additive may be supplied at a selected position to improve distribution of additive through the tow, e.g. to make it more uniform. Thus collected fluid additive and the main supply of fluid additive may be directed at opposite sides of the tow.

The invention will be further described, by way of example only, with reference to the accompanying diagrammatic drawing which is a part-sectional elevation of apparatus for applying plasticiser to a tow of filter material.

The apparatus is asssociated with a filter rod making machine, such as a Molins PM5N, which forms filter tow into a continuous rod and cuts it into individual filter rod lengths. Means including driven rolls 40 are provided for continuously withdrawing a web of filter tow 2 from a supply (e.g. a bale) and moving it through a chamber 4 at a speed normally related to the operating speed of the rod making machine. Subsequently the tow 2 passes to the rod making machine.

In the chamber 4 plasticiser is sprayed onto the tow 2 from a rotating brush 6. Plasticiser is supplied to the brush 6 from a driven roller 8 which receives a surface film of plasticiser from a manifold 10. The arrangement in the chamber 4 for impregnating the tow 2 with plasticiser is similar to that disclosed in British patent specification No. 2054343, the disclosure of which is hereby incorporated herein in full. Some or all of the additional elements contained in the plasticiser chamber described in that application may be embodied in the chambr 4. Alternatively, the chamber 4 may be replaced by any means capable of receiving plasticiser and applying it to a passing tow to achieve an acceptable degree of impregnation.

Plasticiser is supplied to the manifold 10 through a pipe 12 containing a metering pump 14 which may, for example, be of the constant displacement type. The pipe 12 receives plasticiser from a supply reservoir 16.

The pump 14 is driven through an infinitely variable gearbox 18 at a speed which is dependent on the speed of the tow or the rod speed of the rod making machine (which may be directly proportional to the speed of the tow 2) so that a fixed quantity of plasticiser is supplied by the pump 14 for each increment of tow passing through the chamber 4. The value of this quantity is set by the ratio of the gearbox 18, which is controlled by a unit 20 which detects the pump speed and the speed of the input shaft to the gearbox 18 and maintains the gearbox ratio at a predetermined value. This value, which may be preset in the unit 20, may be changed when using a different type of tow and/or plasticiser.

The value may also by varied in accordance with signals received on a line 21 connected to the unit 20 and leading to a beta radiation mass detector (e.g. Molins MODIC) which determines the weight of finished filter rods or to a bale weighing device (e.g. Eastman Continuous Rod Weight Monitoring System, as described in Eastman publication ETB-157) which continuously monitors the reducing weight of the bale from which tow 2 is drawn. Such signals provided on line 21 can vary the value in unit 20 so that the ratio of gearbox 18 is varied to maintain the ratio of plasticiser supply rate (via pump 14) to measured filter production rate or tow consumption rate (by weight) constant.

Not all the plasticiser supplied to the manifold 10 through the pipe 12 is immediately captured by the tow 2 after spraying upwards by the brush 6. The uncaptured plasticiser drains to the bottom of the chamber 4 from which it may pass through a pipe 22 containing a pump 24 for delivery to an elevated cylinder 26. The bottom of the cylinder 26 is connected by a pipe 28 to the manifold 10. A variable restrictor 30 is incorporated in the pipe 28. An overflow pipe 32 leads from near the top of cylinder 26 to the reservoir 16.

Plasticiser drains from the cylinder 26 to the manifold 10 through the pipe 28 and supplements the plasticiser supplied through the pipe 12. The flow of plasticiser through the pipe 28 varies with the height of plasticiser in the cylinder 26. Thus if the proportion of plasticiser uncaptured by the tow increases the level in the cylinder 26 will also tend to increase so that more plasticiser is supplied through the pipe 28 to the manifold 10. Conversely if the proportion of uncaptured plasticiser decreases, so that more is retained by the tow, the level in cylinder 26 falls so that the flow of plasticiser through the pipe 28 also falls. Thus, by providing a secondary supply which varies inversely according to the rate of capture of plasticiser a more even plasticiser application rate can be achieved. In other words the secondary circuit incorporating pipes 22 and 28 operates to damp and correct excessive variations in the supply rate of plasticiser.

The pump 14 is normally set so that it supplies the plasticiser at precisely the rate at which it is required to be applied to the tow. Therefore, when a steady state has been achieved with the level in the cylinder 26 neither rising nor falling plasticiser is being applied at the correct rate. Some adjustment of the metering valve 30 may be initially necessary to allow a steady state to be achieved.

The use of a metering valve 30 to vary the rate of flow through the pipe 28 according the level in the cylinder 26 has the advantage of being simple. At the expense of some simplicity it would be possible to use a system which is potentially more accurate. For example, uncaptured plasticiser may be passed to a secondary reservoir from which it is returned to the chamber 4 by a pump which is driven at a rate depending on the quantity of plasticiser in the secondary reservoir. This alternative arrangement, including a pump 34, pipe 36, and pressure sensor 38 (for determining quantity of plasticiser in reservoir 26) is indicated in dotted lines in the drawing; the portion of pipe 28, including valve 30, by-passed by pipe 36 would be replaced by the pipe 36 and pump 34. A servo-control unit could be provided to control the pump 34 to maintain the level in the secondary reservoir at a substantially constant value. Alternatively, all uncaptured plasticiser collected from the chamber 4 could be returned directly to the chamber 4 without the intermediary of a reservoir.

Collected plasticiser need not be reapplied by the manifold 10. Thus, as indicated in dotted lines in the drawing, the pipe 28 beyond the valve 30 could be replaced by a section 29 having an applicator 31 (e.g. comprising a spray head) which applies the collected plasticiser to the upper side of the tow. The brush 6 and applicator 31 could be laterally spaced relative to the tow path. The section 29 and applicator 31 could be used with the pipe 36 and pump 34.

The control unit 20 may incorporate a counter which displays the number of displacements made by the pump 14 during a preset period (preferably measured in machine time). Thus the unit 20 may display the number of displacements of the pump 14 for every one thousand rods produced by the machine; this number is then directly proportional to the quantity of plasticiser supplied in this period (since the pump is of constant displacement). The counter may be reset every one thousand rods by a pulse derived from the input shaft to the gearbox 18.

I claim:

1. A method of applying fluid additive to a continuously moving tow, comprising supplying fluid additive along a first flow path and applying said additive to the tow on said first flow path, collecting fluid additive not captured by the tow, detecting a quantity of collected fluid additive on a second flow path, reapplying collected fluid additive to the tow on said second flow path, said first and second flow paths being separate at least up to the vicinity of said tow, and varying the rate of reapplication in response to the detected quantity of collected fluid additive to achieve a required final application rate.

2. A method according to claim 1, including measuring at least one tow characteristic and controlling the rate of application in acccordance with the measured characteristic.

3. A method according to claim 1, including the steps of storing the collected fluid additive, and reapplying the collected fluid additive at a variable rate to maintain the quantity of stored fluid additive substantially constant.

4. Apparatus for applying fluid additive to a moving filter tow, including an applicator chamber having a path therethrough for tow, means for supplying the fluid additive to the chamber for application to the tow, said means for applying including applicator means for applying fluid additive to the tow in the chamber, means for collecting fluid additive not captured by the tow, and means for reapplying collected fluid additive to the tow at a rate controllable independently of the rate at which said applicator means applies fluid additive to the tow, wherein said means for reapplying collected fluid includes means for varying the rate of reapplication independently of the rate at which the applicator means applies fluid additive to the tow, the means for varying the rate of reapplication including means for reapplying the collected fluid additive to the tow at any one of a plurality of different rates.

5. Apparatus according to claim 4, wherein said applicator means is connected to receive both fluid additive from said supplying means and collected fluid additive from said reapplying means for application to said tow.

6. Apparatus according to claim 4, further comprising means for applying fresh fluid additive, not previously applied to the tow, to said applicator means, and wherein the means for varying the rate of reapplication varies the rate of reapplication independently of the rate of applying fresh fluid additive to said applicator means.

7. Apparatus according to claim 4, wherein said means for applying fresh fluid additive to said applicator means includes a first flow path; and said means for reapplying collected fluid additive to the tow includes means for applying collected fluid additive to the applicator means, including a second flow path; and wherein said first flow path and said second flow path include portions external to said chamber, which portions are separate from each ohter.

8. Apparatus according to claim 4, wherein the means for reapplying collected fluid additive includes applicator means in said chamber and a flow path leading thereto.

9. Apparatus according to claim 4, wherein said means for supplying fluid additive to the chamber includes control means arranged to vary the rate of supply in accordance with a measured characteristic of the tow.

10. Apparatus according to claim 9, wherein the measured characteristic is speed of the tow.

11. Apparatus according to claim 9 or claim 10, wherein the measured characteristic is weight of the tow or filter rods produced from the tow.

12. Apparatus according to claim 9, wherein the control means is arranged to maintain the rate of supply of fluid additive to the chamber equal to the rate at which it is desired that fluid additive should be captured by the tow.

13. Apparatus for applying fluid additive to a moving filter tow, including an applicator chamber having a path therethrough for tow, means including a first flow path for supplying the fluid additive to the chamber for application to the tow, said first flow path extending into the chamber to apply fluid additive to the tow, said first flow path extending to an applicator device for applying fluid additive to the tow in said chamber, means for collecting fluid additive not captured by the tow, and means for reapplying collected fluid additive to the tow at a rate controllable independently of the rate at which said supplying means supplies fluid additive, said means for reapplying collected fluid additive including means for varying the rate of reapplication independently of the rate at which the supplying means supplies fluid additive, the means for varying the rate of reapplication including means for reapplying the collected fluid additive to the tow at any one of a plurality of different rates, wherein said means for reapplying collected fluid additive includes applicator means in said chamber and a second flow path leading thereto, said first and second flow paths including portions external to said chamber and having no common portions external to said chamber.

14. Apparatus as claimed in claim 13, wherein said chamber includes first and second spaced entrances respectively for said first and second flow paths.

15. Apparatus according to claim 13, wherein said applicator device is positioned in said chamber.

16. Apparatus for applying fluid additive to a moving filter tow, including an applicator chamber having a path therethrough for tow, means for supplying fluid additive to the chamber for application to the tow, the supplying means including means extending into said chamber to apply fluid additive to the tow, means for collecting fluid additive not captured by the tow, and means for reapplying collected fluid additive to the tow at a rate controllable independently of the rate at which said supplying means supplies fluid additive, said means for reapplying including applicator means in said chamber, a flow path leading from said collector means to said applicator means and variable flow control means in said flow path, the variable flow control means including means for reapplying the collected fluid additive to the tow at any one of a plurality of different rates and including variable valve means, and wherein the means extending into the chamber includes further applicator means in said chamber.

17. Apparatus according to claim 16, wherein said variable flow control means is located upstream of the applicator means.

18. Apparatus according to claim 16, including a reservoir for fluid additive in said flow path.

19. Apparatus for applying fluid additive to a moving filter tow, including an applicator chamber having a path therethrough for tow, means for supplying the fluid additive to the chamber for application to the tow, the supplying means including means extending into said chamber to apply fluid additive to the two, means for collecting fluid additive not captured by the two, and means for reapplying collected fluid additive to the tow at a rate controllable independently of the rate at which said supplying means supplies fluid additive, the means for reapplying collected fluid including means for varying the rate of reapplication independently of the rate at which the supplying means supplies fluid additive, the means for reapplying collected fluid additive including applicator means in said chamber and a flow path leading to said applicator means, variable flow control means in said flow path, and a reservoir for fluid additive in said flow path, wherein said reapplying means includes means responsive to quantity of collected fluid additive in said reservoir for varying said flow control means, and wherein the means extending into the chamber includes further applicator means in said chamber.

20. Apparatus according to claim 19, wherein said reservoir for fluid additive is included in said flow path so as to receive collected fluid additive, and is independent of supply of fluid additive from the means for supplying the fluid additive to the chamber.

21. Apparatus according to claim 17, wherein said flow control means comprises a pump.

22. Apparatus according to claim 21, wherein said means responsive to quantity of fluid additive in said reservoir for varying said flow control means comprises means for controlling the pump to maintain the level in said reservoir at a substantially constant value.

23. Apparatus for applying fluid additive to a moving filter tow, including an applicator chamber having a path therethrough for tow, means for supplying fluid additive to the chamber for application to the tow, means for collecting fluid additive not captured by the tow, and means for reapplying collected fluid additive to the tow at a rate controllable independently of the rate at which said supplying means supplies fluid additive, the means for reapplying collected fluid including means for varying the rate of reapplication independently of the rate at which the supplying means supplies fluid additive, the means for reapplying collected fluid additive including applicator means in said chamber and a flow path leading to said applicator means, and variable control means in said flow path, wherein said supplying means includes primary applicator means in said chamber, said primary applicator means and said applicator means being separately located in said chamber.

24. Apparatus according to claim 23, wherein said primary applicator means and said applicator means are located on opposite sides of the tow path.

25. Apparatus according to claim 23 or claim 24, wherein said primary applicator means and said applicator means are laterally spaced with respect to said tow path.

26. A method according to claim 1, in which the rate of application and reapplication of fluid additive to the two are controlled independently respectively on said first and second flow paths.

27. A method according to claim 26, including controlling the rate of application so that it is equal to said required final application rate.

28. Apparatus for applying fluid additive to a moving filter tow, including an applicator chamber having a path therethrough for tow, means for supplying fluid additive to the chamber along a first flow path for application to the tow, means for collecting fluid additive not captured by the tow, and means for reapplying collected fluid additive to the tow at a rate controllable independently of the rate at which said supplying means supplies fluid additive, said means for reapplying including applicator means in said chamber, a second flow path leading from said collector means to said applicator means and variable flow control means in said second flow path, and including a reservoir for fluid additive in said second flow path, and further comprising a main reservoir for said fluid additive, said main reservoir being in flow communication with said supplying means by way of said first flow path, and further including an overflow pipe for said reservoir, leading from near the top of said reservoir to said main reservoir, said first and second flow paths including separately located portions entering said chember.

29. A method of applying fluid additive to a continuously moving tow, comprising supplying fluid additive along a first flow path and applying said additive to the tow on said first flow path, collecting fluid additive not captured by the tow, storing collected fluid additive on a second flow path, reapplying collected fluid additive to the tow on said second flow path, and varying the rate of reapplication to achieve a required final application rate and to maintain the quantity of stored collected fluid additive substantially constant, including the steps of detecting the quantity of stored collected fluid additive and accordingly varying the flow rate from the stored quantity of collected fluid additive on said second flow path without affecting the flow rate on said first flow path.

30. A method according to claim 29, wherein the collected fluid additive is stored independent of the fluid additive supplied along the first flow path.

31. Apparatus for applying fluid additive to a moving filter tow, including an applicator chamber having a path therethrough for tow, means for supplying fluid additive for application to the tow, including primary applicator means in the chamber, means for collecting at a first location within the chamber fluid additive not captured by the tow, and means for reapplying collected fluid additive to the tow from a second location within the chamber, said reapplying means including secondary applicator means in the chamber, wherein said first and second locations are connected by a flow path at least partly external to said chamber and said primary and secondary applicators occupy spaced positions in said chamber.

32. Apparatus according to claim 31, wherein said flow path includes a reservoir.

33. Apparatus for applying fluid additive to a moving filter tow, including an applicator chamber having a path therethrough for the tow, means for supplying fluid additive along a first flow path to the chamber for application to the tow, said first flow path extending into the chamber to an applicator device for applying fluid additive to the tow in said chamber, means for collecting at a first location within the chamber fluid additive not captured by the tow, and means for reapplying collected fluid additive to the tow from a second location within the chamber, said first and second locations being connected by a second flow path at least partly external to said chamber and said second flow path including a variable flow control means, said variable flow control means including means for reapplying collected fluid additive at any one of a plurality of different rates without affecting the rate of supply of fluid additive on said first flow path.

34. Apparatus according to claim 32, wherein said applicator device is positioned in said chamber.

35. Apparatus for applying fluid additive to a moving filter tow, including an applicator chamber having a path therethrough for tow, means for supplying fluid additive to the chamber for application to the tow, including primary applicator means in the chamber, means for collecting at a first location within the chamber fluid additive not captured by the tow, and secondary applicator means in the chamber for reapplying collected fluid additive to the tow from a second location within the chamber, wherein the first and second locations are on opposite sides of the tow path through the chamber and connected by a flow path at least partly external to said chamber.

36. Apparatus for applying fluid additive to a moving filter tow, including an applicator chamber having a path therethrough for tow, means for supplying the fluid additive to the chamber for application to the tow, means for collecting fluid additive not captured by the tow, and means for reapplying collected fluid additive to the tow, said means for reapplying collected fluid additive including means for varying the rate of reapplication independently of the rate at which the supplying means supplies fluid additive, wherein said means for supplying fluid additive includes control means arranged to vary the rate of supply in accordance with the measured weight of the tow or filter rods produced from the tow.

37. Apparatus for applying fluid additive to a moving filter tow, including an applicator chamber having a path therethrough for tow, means for supplying the fluid additive to the chamber for application to the tow, means for collecting fluid additive not captured by the tow, and means for reapplying collected fluid additive to the tow at a rate controllable independently of the rate at which said supplying means supplies fluid additive, said means for reapplying collected fluid additive including means for varying the rate of reapplication independently of the rate at which the supplying means supplies fluid additive, said supplying means and said reapplying means including common applicator means in said chamber, said common applicator means being connected to receive both fluid additive from said supplying means and collected fluid additive from said reapplying means for application to said tow, said supplying means including control means arranged to vary the rate of supply of fluid additive to the chamber in accordance with measured weight of the tow or filter rods produced from the tow.

38. Apparatus for applying fluid additive to a moving filter tow, including an applicator chamber having a path therethrough for tow, means for supplying fluid additive to the chamber for application to the tow, including primary applicator means in the chamber, means for collecting at a first location within the chamber fluid additive not captured by the tow, and secondary applicator means in the chamber for reapplying collected fluid additive to the tow from a second location within the chamber, wherein the first and second locations are on opposite sides of the tow path through the chamber, and wherein said secondary applicator means includes means for directing the collected fluid additive toward the tow for reapplying the collected fluid additive to the tow.

39. A method of applying fluid additive to a continuously moving tow, comprising supplying fluid additive along a first flow path, and applying said additive to the tow, collecting fluid additive not captured by the tow, reapplying collected fluid additive to the tow along a second flow path, controlling the rate of application of fluid additive to the tow by progressively varying the flow rate on said second flow path without affecting the flow rate on said first flow path, and maintaining said first and second flow paths separate up to applying additive to the tow.

40. Apparatus for applying fluid additive to a moving filter tow, including an applicator chamber having a path therethrough for tow, means for supplying fluid additive to the chamber for application to the tow, the supplying means including means extending into said chamber to apply fluid additive to the tow, means for collecting fluid additive not captured by the tow, and means for reapplying collected fluid additive to the tow at a rate controllable independently of the rate at which said supplying means supplies fluid additive, said means for reapplying including applicator means in said chamber, said means extending into said chamber including further applicator means in said chamber, a flow path leading from said collector means to said applicator means including a reservoir for fluid additive in said flow path, and variable flow control means in said flow path, the variable flow control means including means for reapplying the collected fluid additive to the tow at any one of a plurality of different rates, wherein said reapplying means includes means responsive to quantity of fluid additive in said reservoir for varying said flow control means, and wherein said flow control means comprises a variable restrictor valve.

41. Apparatus according to claim 16, 19 or 40, wherein said applicator means and further applicator means include a common applicator.

* * * * *